US006575801B1

(12) United States Patent
Lee et al.

(10) Patent No.: US 6,575,801 B1
(45) Date of Patent: Jun. 10, 2003

(54) METHOD FOR FABRICATING CATHODE IN COLOR CATHODE RAY TUBE

(75) Inventors: Gyeong Sang Lee, Kyongsangbuk-do (KR); Byoung Doo Ko, Kyongsangbuk-do (KR); Young Deog Koh, Seoul (KR); Dawa Yashiro, Tokyo (JP); Matsuo Tosihiro, Tokyo (JP); Huruya Koushi, Tokyo (JP); Yagima Taeruo, Tokyo (JP)

(73) Assignee: LG Electronics Inc., Seoul (KR)

( * ) Notice: Subject to any disclaimer, the term of this patent is extended or adjusted under 35 U.S.C. 154(b) by 340 days.

(21) Appl. No.: 09/706,601

(22) Filed: Nov. 7, 2000

(30) Foreign Application Priority Data

Nov. 8, 1999 (KR) ..... 99/49243

(51) Int. Cl.[7] ..... H01J 9/12; B05D 5/12

(52) U.S. Cl. ..... 445/36; 445/51; 445/50; 427/123; 427/124

(58) Field of Search ..... 445/36, 50, 51, 445/40; 427/124, 126.1, 126.3, 126.4, 472, 476, 105; 313/341, 310, 346 R

(56) References Cited

U.S. PATENT DOCUMENTS 4,183,975 A * 1/1980 Sidders ..... 427/593
5,102,363 A * 4/1992 Koizumi ..... 445/36
5,118,317 A * 6/1992 Wijnen ..... 445/50
5,220,238 A * 6/1993 Lee ..... 313/270

* cited by examiner

*Primary Examiner*—Kenneth J. Ramsey
*Assistant Examiner*—German Colón
(74) *Attorney, Agent, or Firm*—Fleshner & Kim, LLP

(57) ABSTRACT

Method for fabricating a cathode in a cathode ray tube, the cathode having a cathode sleeve with a heat radiative coating layer formed on an inside wall thereof for emission of thermal electrons, the heat radiative coating layer being formed by a method including the steps of (a) coating a material of the heat radiative coating layer on a surface of a metal wire provided separately, (b) inserting the metal wire having the heat radiative coating layer coated thereon, to pass through an opening the cylindrical cathode sleeve, and (c) heating the metal wire by providing a power thereto, to deposit the material of the heat radiative coating layer coated on the metal wire on the inside wall of the cathode sleeve, whereby permitting to coat many number of cathode sleeves at a time, and to form a film of uniform composition and even thickness to enhance electron emission.

11 Claims, 2 Drawing Sheets

METHOD FOR FABRICATING CATHODE IN COLOR CATHODE RAY TUBE

BACKGROUND OF THE INVENTION

1. Field of the Invention

The present invention relates to a method for fabricating a cathode in a cathode ray tube, and more particularly, to a method for fabricating a cathode in a cathode ray tube, in which a heat radiative material coating is applied to a metal wire, and the metal wire is inserted and passed through an opening of a cylindrical cathode sleeve and heated by providing a voltage thereto, to deposit the heat radiative material on an inside wall of the cathode sleeve, for improving electron emission characteristics of the cathode.

2. Background of the Related Art

Recently, cathode ray tubes, such as color picture tubes, have employed impregnated type cathodes for high current density which have been used in electron tubes, such as traveling wave tubes and klystrons, to cope with the trend of providing high definition pictures and large sized screens.

Referring to FIG. 1, the impregnated type cathode is provided with a cathode body 1 of porous refractory metal having an electron emission material, such as barium, calcium, aluminate, and etc., impregnated therein, a cylindrical cathode cup 2 having one side closed and the cathode body 1 inserted therein, a cylindrical cathode sleeve 3 having both ends opened and the cathode cup 2 inserted into an opening thereof starting from the closed side, and a heater 4 inserted in the cathode ray tube 3 for heating the cathode. The cathode sleeve 3 is supported. coaxially on a central portion of a cylindrical holder 5 having both ends opened spaced by three ribbons 6. Any of the cathode cup 2, the cathode sleeve 3, and the ribbons 6 are formed of a metal or alloy having at least one of tantalum Ta, niobium Nb, and molybdenum Mo as a major composition. And, there is a heat radiative coating 7 of tungsten W and alumina composition on an inside wall of the cathode sleeve 3 for making the cathode sleeve 3 to absorb a heat generated from the heater 4 efficiently. For example, the cathode sleeve 3 has a form of thin and long pipe with a 15~20 $\mu$m thickness, 1.23 mm in diameter, and 4.3 mm in length. For example, as disclosed in Japanese Laid Open Patent H7-65714, the heat radiative coating 7 may be formed on the inside wall of the cathode sleeve 3 by disposing a 15 mm thick cathode sleeve vertically, inserting a fore end of a nozzle of an injector into the cathode sleeve a little from a top side of the cathode sleeve, injecting and removing a suspension of a mixture of required quantity of tungsten powder and alumina powder, thereby adsorbing the coating materials on the inside surface of the cathode sleeve. Then, the cathode sleeve the coating materials adsorbed thereto is heated at 1500° C. for 10 min. under a vacuum, to form the heat radiative coating of approx. 5 $\mu$m thickness. However, the Japanese Laid Open Patent H7-65714 has difficulty in that composition of the suspension is kept uniform owing to continuous vaporization of solvent from the suspension in the injector and a difference of densities of tungsten particles and alumina particles in a case a plurality of inside walls of the cathode sleeves are heat radiative coated. Consequently, it is liable that there can be deviations in a blackness and heat radiation of the coating on the inside wall of the cathode sleeve, and since the 15~20 $\mu$m thick cathode sleeve is susceptible to embrittlement during the heat treatment at 1500° C. for 10 min. in a vacuum ambient, the cathode sleeve may be broken in the next fabrication process of cathode assembly.

Moreover, though the purpose of the heat radiative coating is to make a heat generated at the heater to be absorbed by a circumference of the cathode sleeve, the heat radiative coating may fall off in the middle of operation or involved in a great heat loss with a consequential poor thermal efficiency if the heat radiative coating is thick. Therefore, the thickness of the heat radiative coating should be thinner for prevention of coating fall off and reducing a heat loss.

SUMMARY OF THE INVENTION

Accordingly, the present invention is directed to a method for fabricating a cathode in a cathode ray tube that substantially obviates one or more of the problems due to limitations and disadvantages of the related art.

An object of the present invention is to provide a method for fabricating a cathode in a cathode ray tube, which has a uniform heat radiation rate, can suppress embrittlement of the cathode sleeve, and permits to coat a plurality of inside walls of cathode sleeves on the same time.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for fabricating a cathode in a cathode ray tube, the cathode having a cathode sleeve with a heat radiative coating layer formed on an inside wall thereof for emission of thermal electrons, the heat radiative coating layer being formed by a method including the steps of (a) coating a material of the heat radiative coating layer on a surface of a metal wire provided separately, (b) inserting the metal wire having the heat radiative coating layer coated thereon, to pass through an opening the cylindrical cathode sleeve, and (c) heating the metal wire by providing a power thereto, to deposit the material of the heat radiative coating layer coated on the metal wire on the inside wall of the cathode sleeve.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
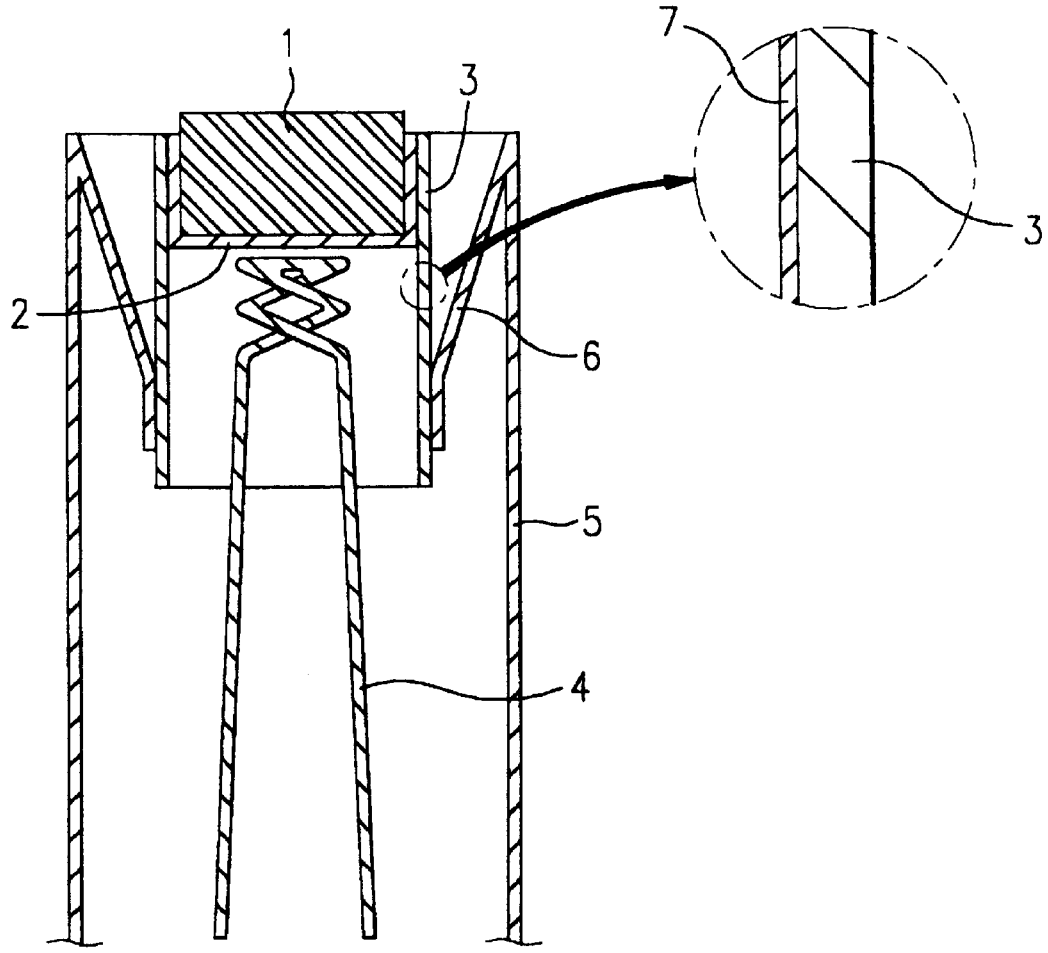
FIG. 1 illustrates a section of a cathode structural body in a cathode ray tube; and, FIG. 2 illustrates formation of a heat radiative coating on an inside wall of a cathode sleeve by using a metal wire.
Figure 2:
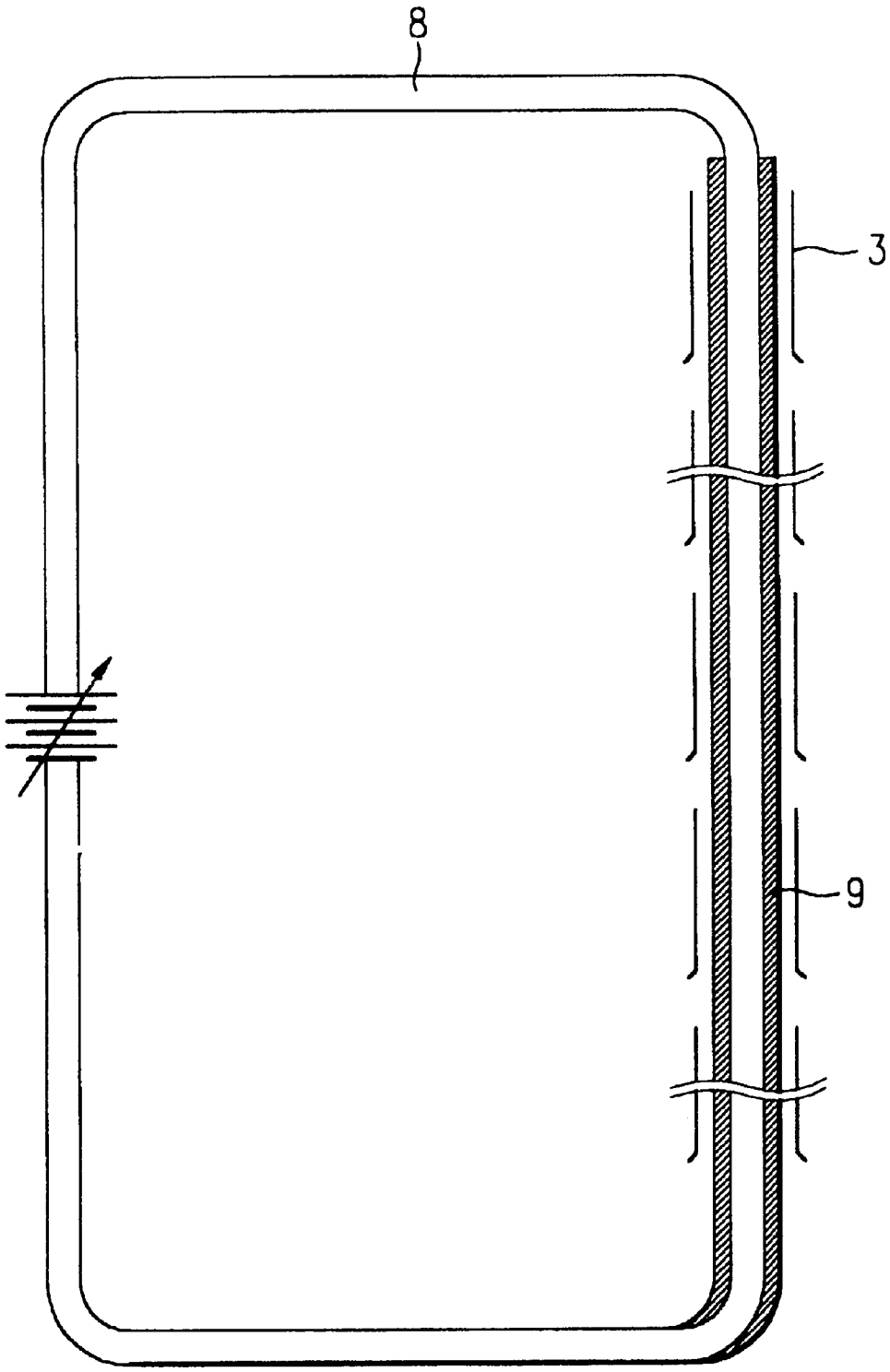

Reference will now be made in detail to the preferred embodiments of the present invention, examples of which are illustrated in the accompanying drawings. In explanations of the embodiments of the present invention, identical components will be given the same names and reference symbols, and explanations of which will be omitted. FIG. 2 illustrates formation of a heat radiative coating on an inside wall of a cathode sleeve by using a metal wire.

Referring to FIG. 2, the heat radiative coating 9 material to be coated on a metal wire 8 of tungsten or molybdenum with a fixed diameter is tungsten powder with a 0.5~2.0 μm average diameter and alumina powder with a 0.5~10 μm average diameter mixed in 40:60~90:10 weight composition ratio dispersed in a polymer binder solution, which is to be deposited on an inside wall of a cathode sleeve 3. In the formation of the heat radiative coating, by dipping a separate metal wire into the adequately stirred solution of the heat radiative coating material, the heat radiative coating material can be coated on the metal wire, uniformly. In this instance, by controlling time periods and times of the dipping, a thickness of the coating can be controlled. Thus, since it is easy to coat the heat radiative coating 9 material on a surface of the metal wire evenly, the present invention permits to form a plurality of heat radiative coatings each having a uniform composition and an even thickness on the inside walls of the cathode sleeves on the same time. The appropriate selection of a diameter of the metal wire and the thickness of the heat radiative coating material to be coated on the metal wire permitted in the present invention, which in turn permits to regulate a distance between a metal wire surface having the heat radiative material coated thereon and the inside wall of the cathode sleeve, can prevent embrittlement of the cathode sleeve since regulation of temperature rise of the cathode sleeve is possible in deposition of the coating material by providing power to and heating the metal wire, and, moreover, can regulate a deposited thickness of the heat radiative coating to be minimum by regulating a time period of providing a power to, and heating the metal wire. The metal wire in the present invention is formed of at least one selected from molybdenum Mo or an alloy of molybdenum as major composition, tungsten W or an alloy of tungsten as major composition, chrome Cr or an alloy of chrome as major composition. And, the cathode sleeve is formed of at least one selected from tantalum Ta or an alloy of tantalum Ta as major composition, molybdenum Mo or an alloy of molybdenum as major composition, and nickel Ni or an alloy of nickel as major composition.

An embodiment of the present invention will be explained.

A molybdenum wire with 0.3 mm diameter is selected as the metal wire, and the heat radiative coating material to be coated on the surface of the metal wire is prepared by dispersing tungsten powder with a 0.5 μm average diameter and alumina powder with 0.5 μm average diameter mixed in 60:40 weight composition ratio in a polymer binder solution. Then, the metal wire is dipped into a solution of an adequately stirred heat radiative coating material until the heat radiative coating material is coated evenly on the metal wire to a thickness of 0.1 mm. The coating may be done not only by the dipping, but also by other means, such as electrodeposition and the like. The metal wire with the heat radiative coating material coated thereon is dried, and inserted, and passed through the openings of 100 of the cathode sleeves, as shown in FIG. 2. The cathode sleeve in this embodiment is a thin long pipe of tantalum Ta with a 15 μm thickness, a 1.23 mm outside diameter, and 4.3 mm length. Then, a power is provided to the metal wire in a vacuum ambient, to heat the metal wire, for depositing the heat radiative coating material on the inside surface of the cathode sleeve. The heat radiative coating material may be heated, not only by providing the power directly thereto, but also by RF induction heating indirectly, which is more effective. During the heating, the vacuum is at 1×10E(−6) Torr, a surface temperature of the metal wire having no heat radiative coating material coated thereon is 1600° C., an outside surface temperature of the cathode sleeve is 1200° C.~1250° C. The above temperatures are measured by a radiation pyrometer. Because the heat radiative coating material is disposed between the cathode sleeve and the metal wire spaced by an insulating material, and there is no direct contact between the cathode sleeve and the metal wire, the cathode sleeve is not heated by no current provided thereto. And, because an-inside diameter of the cathode sleeve is 1.2 mm, an one side gap between the inside surface of the cathode sleeve and the surface of the heat radiative coating material is in a range of 0.35 mm, a temperature of the cathode sleeve can be made very lower than a temperature of the metal wire. The power is provided to the metal wire for 10 minutes.

Thus, the method for fabricating a cathode in a cathode ray tube of the present invention can provide the heat radiative coating of a thickness below 1 μm on the inside surface of the cathode sleeve, with adequate blackness, evenness, bonding force enough to show no fall off during cathode ray operation test, and an adequate heat absorption. And, as the cathode sleeve is not embrittled at all, the cathode sleeve shows no problems of breakage and the like in a cathode assembly process. Contrary to this, the cathode sleeve heated as the power is provided thereto is embrittled at a temperature 1400° C. at an outside surface of the cathode sleeve, such that the cathode sleeve is broken in a cathode assembly process carried out later, particularly, when the cathode cup is inserted into the opening of the cathode sleeve.

In the meantime, when a strong heat radiative coating good for practical use is formed in the related art by injecting the heat radiative coating material into an inside of the cathode sleeve, removing surplus by using porous adsorbent or vacuum suction to finish coating the inside of the cathode sleeve, and heating for a short time period within one hour after the coating is finished, a heating temperature higher than 1500° C. is required at which the cathode sleeve is embrittled, and though deposition of the heat radiative coating material below 1 μm, which is required to be minimum as far as possible, is not possible by the direct deposition of particles in the related art, the present invention permits to form the deposition of the heat radiative coating material to be below 1 μm. In the foregoing embodiment, any of the cathode cup 2, the cathode sleeve 3, and the ribbon 6 can be formed of an alloy of more than one material selected from tantalum Ta, niobium Nb, molybdenum Mo as major composition in an impregnated type. And, the present invention is applicable to a case of oxide cathode having a temperature approx. 200° C. lower than the impregnated type cathode by forming the cathode sleeve of nickel or an alloy including at least nickel. Particularly, as an example of the alloy including at least nickel, a cathode sleeve in the related art oxide cathode can be used as it is if the cathode sleeve is formed of an alloy including at least nickel-chrome.

As has been explained, the method for fabricating a cathode in a cathode ray tube can coat a heat radiative coating material on an inside surface of a plurality of cathode sleeves at a time to permit coating many number of cathode sleeves at a time, and a film of uniform composition and even thickness to enhance electron emission by applying a heat radiative material coating to a metal wire, inserting the metal wire and passing through an opening of a cylindrical cathode sleeve and heating by providing a voltage thereto.

It will be apparent to those skilled in the art that various modifications and variations can be made in the method for fabricating a cathode in a cathode ray tube of the present invention without departing from the spirit or scope of the invention. Thus, it is intended that the present invention cover the modifications and variations of this invention provided they come within the scope of the appended claims and their equivalents.

What is claimed is:

1. A method for fabricating a cathode in a cathode ray tube, the cathode having a cathode sleeve with a heat radiative coating layer formed on an inside wall thereof for emission of thermal electrons, the heat radiative coating layer being formed by a method comprising the steps of:

(a) coating a material of the heat radiative coating layer on a surface of a metal wire provided, separately;

(b) inserting the metal wire having the heat radiative coating layer coated thereon, to pass through an opening the cathode sleeve; and, (c) heating the metal wire by providing a power thereto, to deposit the material of the heat radiative coating layer coated on the metal wire on the inside wall of the cathode sleeve.

2. A method as claimed in claim 1, wherein the material of the heat radiative coating layer coated on the metal wire is a mixture of at least tungsten W and alumina.

3. A method as claimed in claim 2, wherein the tungsten W has a particle size of 0.5~2.0 $\mu$m, and the alumina has a particle size of 0.5~10 $\mu$m.

4. A method as claimed in claim 2 wherein the mixture of the tungsten and alumina has a ratio of mix in a range of 40:60~90:10 by weight.

5. A method as claimed in claim 1, wherein the cathode sleeve is formed of at least one selected from tantalum Ta or an alloy of tantalum Ta as major composition, molybdenum Mo or an alloy of molybdenum as major composition, and nickel Ni or an alloy of nickel as major composition.

6. A method as claimed in claim 5, wherein the alloy includes nickel Ni and chrome Cr with the nickel included as major composition.

7. A method as claimed in claim 1, wherein the metal wire having the heat radiative coating layer to be coated thereon is formed of at least one selected from molybdenum Mo or an alloy of molybdenum as major composition, tungsten W or an alloy of tungsten as major composition, chrome Cr or an alloy of chrome as major composition.

8. A method as claimed in claim 7, wherein the alloy having tungsten as major composition includes tungsten and rhenium.

9. A method as claimed in claim 1, wherein the metal wire is heated by providing a power in a RF induction heating type.

10. A method as claimed in claim 1, wherein the metal wire is heated by providing a power under a vacuum.

11. A method as claimed in claim 1, wherein the cathode sleeve is heated in the heating of the metal wire by providing a power such that an outside temperature of the cathode sleeve is not higher than 1400° C. (a luminance temperature).

* * * * *